United States Patent [19]

Lutz, Sr.

[11] 4,373,633

[45] Feb. 15, 1983

[54] STACKABLE CAN

[76] Inventor: Milton F. Lutz, Sr., 5906 Wolf Lake Rd., Grass Lake, Mich. 49241

[21] Appl. No.: 301,454

[22] Filed: Sep. 14, 1981

[51] Int. Cl.[3] ..... B65D 21/02

[52] U.S. Cl. ..... 206/508; 206/509; 206/511

[58] Field of Search ..... 206/508, 509, 511

[56] References Cited

U.S. PATENT DOCUMENTS

| | | | |
|---|---|---|---|
| 1,626,930 | 5/1927 | Grogg | 206/508 |
| 2,089,624 | 8/1937 | Smith | 206/511 |
| 2,146,925 | 2/1939 | Ahrbecker | 206/511 |
| 2,293,424 | 8/1942 | Costa | 220/97 |
| 2,822,952 | 2/1958 | Scott | 220/97 |
| 2,833,452 | 5/1958 | Drummond et al. | 222/555 |
| 3,070,257 | 12/1962 | Bojanowski | 220/97 |
| 3,103,278 | 9/1963 | Kazma | 206/511 |
| 3,878,963 | 4/1975 | Knize | 220/66 |

FOREIGN PATENT DOCUMENTS

| | | | |
|---|---|---|---|
| 1394391 | 2/1965 | France | 206/508 |

*Primary Examiner*—George E. Lowrance
*Attorney, Agent, or Firm*—Beaman & Beaman

[57] ABSTRACT

The invention pertains to containers capable of being vertically stacked, and in particular, relates to lids and bottoms for cans which facilitate stacking. The can lids and bottoms are identical, formed of a generally planar sheet metal body having an annular ridge extending from the body plane which projects beyond the plane of the can rolled edge. Alternate depressions and projections of complementary configuration and dimension are defined upon the ridge wherein the stacking of cans permits the recesses of one can to receive the projections of the adjacent can end, the interconnection of the recesses and projections resisting lateral can displacement, and producing an "indexed" interlocking between stacked cans.

2 Claims, 5 Drawing Figures

STACKABLE CAN

BACKGROUND OF THE INVENTION

Conventional cans such as used in the packaging of food, consist of a body or side wall rolled into a cylinder sealed at each end by identical lid and bottom elements usually connected to the side by a rolled bead. Sealing of the joints may include soldering, and the ends of the can wall axially extend beyond the plane of the lid or bottom defining an annular end lying in a terminal plane of the can.

For storage or display purposes, cans are often vertically stacked one upon the other, and to do so it is necessary to accurately coaxially align the stacked cans of identical size whereby the upper edge of the lower can is in accurate alignment with the lower edge of the can above. Slight misalignment causes the edge of the upper can to "fall" within the upper edge of the lower can to engage the lower can lid, rather than the rolled bead edge, and causing the upper can to tilt. As lateral shifting of the cans is only resisted by the friction of the engaging can's bead edges it is difficult to satisfactorily stack cans of identical size to prevent tipping, and to stack more than two cans together is impractical for most purposes.

A variety of solutions have been proposed to permit cans to be stacked in vertical relationship, and proposals are shown in U.S. Pat. Nos. 2,293,424; 2,822,952; 2,833,452; 3,070,257 and 3,878,963. Problems arise with previously proposed can nesting apparatus in that the lid can bottoms are often not identical, the cost or production is excessive, the devices interfere with the operation of conventional can openers, or the can lids and bottoms cannot be utilized with conventional can fabrication apparatus.

It is an object of the invention to provide an end for cans wherein cans of identical size may be readily stacked and are mechanically interrelated to maintain the stacked relationship.

Another object of the invention is to provide a can end which facilitates stacking of cans of identical size, and wherein the can ends do not interfere with the normal use, packaging, opening and handling of the cans.

A further object of the invention is to provide an end for cans which facilitates stacking, and the can ends are of such construction to be readily accommodated by conventional can fabrication and sealing apparatus.

Yet another object of the invention is to provide an end for cans which is of such configuration to facilitate stacking of identical can sizes, and the configuration of the can ends do not interfere with conventional assembly of the ends to the can body, nor interfere with opening of the cans with conventional can openers.

In the practice of the invention the can end, whether it constitutes a lid or a bottom, is identical, and is of a generally planar configuration having a circular periphery adapted to be sealed to the can body end in the conventional manner, such as by a rolled bead.

The can ends include an annular ridge concentrically formed upon the end member radially spaced inwardly from the periphery, and axially extending outwardly with respect to the can configuration. The ridge terminates in a flat support surface which is parallel to the plane of the can end, and the support surface axially extends from the plane of the can end a distance substantially equal to, or greater than, the dimension that the general plane of the end is inwardly located with respect to the end of the can body as defined by the rolled bead, the rolled bead end defining the terminal plane of the can body. Thus, the stacking of cans utilizing the can end of the invention results in engagement of the ridge support surfaces.

The ridge support surface is provided with a plurality of concave recesses and convex projections, alternately defined upon the support surface about the can end axis. The recesses and projections are of a complementary configuration, all being located at the same radial location from the can end axis whereby upon stacking cans the projections of one can end are firmly received within the recesses of the opposed can end upon the two cans being angularly related to align the opposed recesses and projections.

The mechanical interlocking of the recesses and projections of stacked cans prevents a lateral shifting or displacement, and the use of the recesses and projections prevents relative rotation of stacked cans about their axis wherein a predetermined "indexed" relationship between stacked cans may be maintained.

The projections axially extend beyond the can terminal plane wherein the projections constitute the support for the can when placed upon a shelf or other flat surface. As the projections, and ridge support surface, are located relatively adjacent the periphery of the can end the projections provide a stable support for the associated can when resting upon a flat surface.

BRIEF DESCRIPTION OF THE PREFERRED DRAWINGS

The aforementioned objects and advantages of the invention will be appreciated from the following description and accompanying drawings wherein:

FIG. 1 is an elevational view of two cans in stacked relationship incorporating can ends in accord with the invention, FIG. 2 is an enlarged perspective view of a can and can end in accord with the invention, FIG. 3 is an enlarged, detail, cross sectional elevational view illustrating the interrelationship of interconnected can ends in accord with the invention, FIG. 4 is a top elevational view of a can end, and FIG. 5 is a perspective view of the inner side of a can lid in accord with the invention.

DESCRIPTION OF THE PREFERRED EMBODIMENT

In the following description the terms "can end", "lid", or "bottom" refer to the same element, namely the sheet metal member employed to close the ends of a conventional can or tin. For purpose of uniformity the term "can end" will be employed in most instances.

Figure 1:
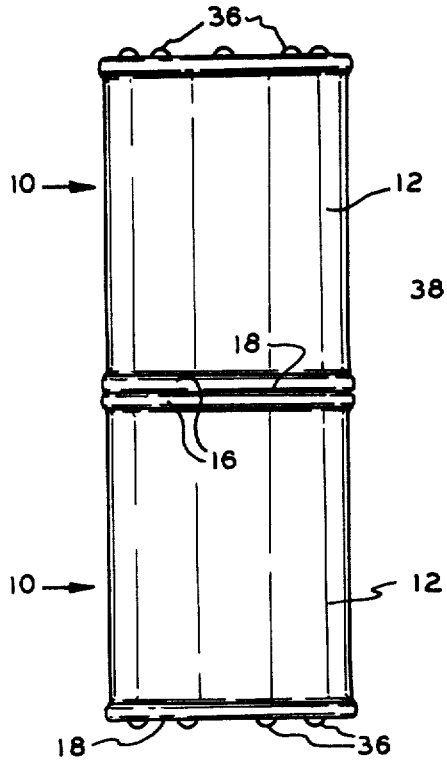
Figure 2:
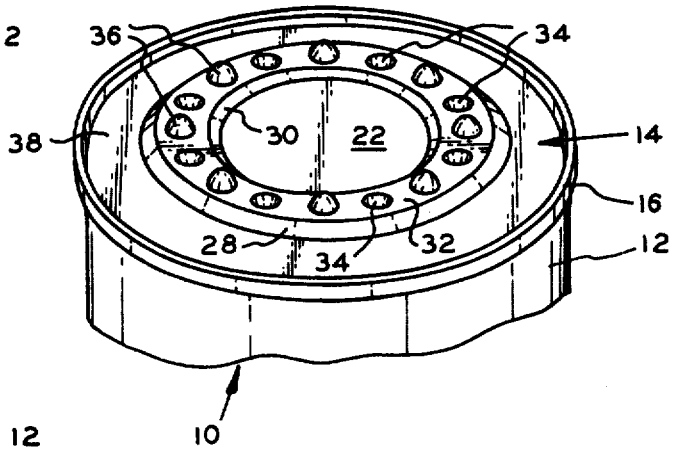

As illustrated in FIG. 1, the conventional can 10 with which the can end of the invention is employed includes a cylindrical body wall 12 usually including a soldered seam extending the length of the body. The circular ends of the body wall are sealed by the can ends 14, which are of identical configuration, and the sealing between the body wall 12 and the ends 14 is produced by a rolled bead 16, FIG. 3, into which the periphery of the ends 14 are incorporated in a sealed manner. The outermost edge 18 of the rolled bead 16 lies in a plane defining the maximum length of the body wall 12, and, for purpose of description, the edge 18 of the rolled bead is considered to lie in the terminal plane of a can 10.

The can end 14, in accord with the invention, is formed of conventional sheet metal, and is of a circular configuration having a peripheral edge 20. The end 14 has a generally planar form throughout its configuration having an outer side represented at 22, and an inner side 24.

An annular ridge 26 is defined upon the can end 14 radially inward of the periphery 20 and concentric thereto and consists of obliquely disposed surfaces 28 and 30 and a planar support surface 32. The ridge 26 is formed of the material of the can end and axially extends from the general plane of the can end in the direction of the outer side 22. The planar support surface 32 is parallel to the general plane of the can end 14, and is off-set with respect to the general plane thereof by a distance at least equal to the distance between the can end general plane and the can bead terminal edge 18 as represented by dimension A in FIG. 3. Thus, when the end 14 is assembled to the can body wall 12 by the rolled beads 16 the plane of the support surface 32 will coincide with the terminal plane of the associated can body, or extend outwardly therefrom a slight distance.

A plurality of recesses 34 and projections 36 are defined upon the ridge support surface 32 in an alternating manner. The recesses 34 comprise rounded, concave, indentations of the metal of the ridge support surface deformed in the direction of the can end inner side 24. The projections 36 extend outwardly from the support surface 32 and have a rounded, convex configuration, and the recesses and projections are of complementary configurations to closely nest one inside the other when properly aligned, as illustrated in FIG. 3.

Figure 4:
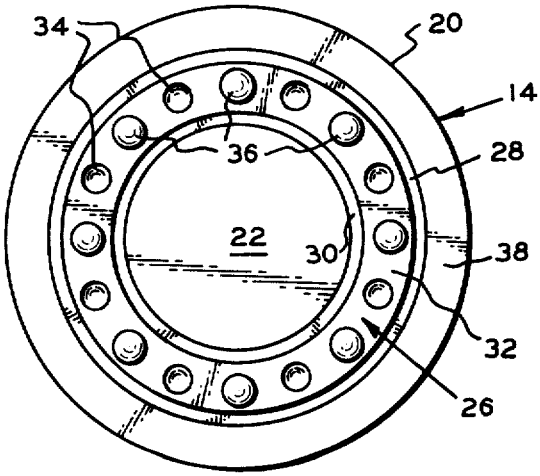
Figure 5:
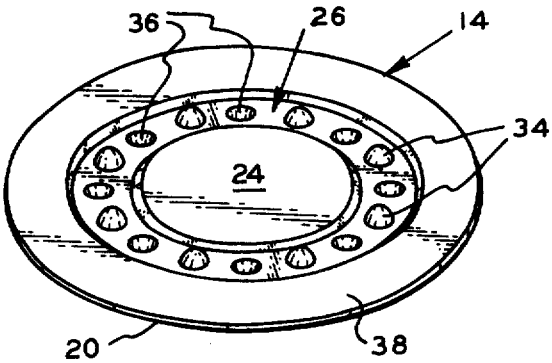

The diameter of the recesses 34 and projections 36 is less than the radial width of the support surface, as will be appreciated from FIG. 4, and the recesses and projections are at the same radial dimension from the center of the associated can end 14. In the preferred arrangement, the recesses and projections alternate with respect to the orientation about the central axis of the associated can end, the adjacent recesses and projections preferably being approximately ¼" apart.

It will be noted that a flat ring 38 exists between the periphery 20 and the ridge 26 which lies within the plane of the can end 14, and this ring insures that the shape of the can end will not interfere with the use of conventional can openers.

Figure 3:
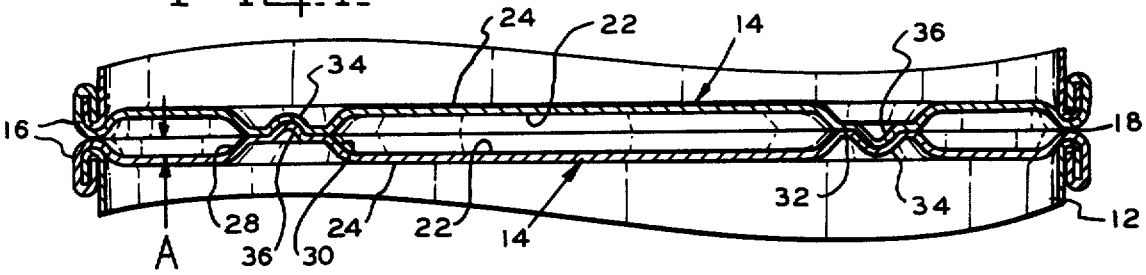

The can ends 14 in accord with the invention are assembled to the can body by the rolled bead 16 in the manner apparent in FIG. 3. The can end is positioned relative to the can body wall 12 such that the ridge 26 extends away from the volume defined by the can 10, and this orientation causes the projections 36 to axially extend beyond the can terminal edge 18 as will be appreciated from FIG. 1. Accordingly, when stacking cans 10 of similar size one upon the other, the projections 36 of the upper can can be made to align with the recesses of the can end 14 immediately therebelow wherein the mechanical "nesting" and interrelationship shown in FIG. 3 is accomplished. To align the recesses 34 and projections 36 of stacked cans it is only necessary to align the rolled beads 16 of the cans and slightly rotate one can relative to the other until the recesses align with the projections. The rounded configuration of the recesses and projections facilitates the nesting of these components, and cans utilizing the invention can be quickly and accurately stacked.

As the recesses and projections will hold the stacked cans in a given "indexed" relationship, the labels of the cans may be readily aligned and oriented, if desired, for display purposes, and the interconnection between the recesses and projections produces substantial resistance to relative lateral displacement of the stacked cans minimizing the likelihood that the cans will become misaligned, and fall.

The radial, planar, space 38 exists between the periphery 20 and the ridge surface 28 and this space prevents the can end configuration from interfering with the operation of conventional can openers, and the configuration of the can end is such as to be readily accommodated within conventional can fabrication and assembly apparatus. The forming of a can end 14 in accord with the invention is quickly and easily achieved by a stamping operation at high speed, and the practice of the invention adds very little cost to the can end as compared with conventional shapes.

The presence of the projections 36 extending beyond the terminal plane of the can ends creates no problems with respect to handling and packaging, and the projections will function as "legs" and engage a flat shelf or support surface for supporting the lowermost can in a firm manner. As the projections 36 are located substantially near the can rolled edge 16 a firm base of support for the associated can body is provided.

It is appreciated that various modifications to the inventive concepts may be apparent to those skilled in the art without departing from the spirit and scope of the invention.

I claim:

1. An end for a can characterized by its ability to interrelate with a similar can end to facilitate the vertical stacking of cans comprising, in combination, a substantially flat sheet metal member having an axis, a general plane of configuration perpendicular to said axis, an inner side, an outer side and a periphery, an annular ridge defined on said member from the material thereof axially extending from said general plane on said outer side concentric to said member axis and radially spaced inwardly of said periphery, said ridge including a flat support surface substantially parallel to said member general plane comprising the maximum axial extension of said ridge from said member general plane, a plurality of axially extending rounded and concave recesses defined in said ridge support surface, a plurality of axially extending rounded and convex projections defined in said ridge support surface complementary in configuration and dimension to said recesses, said recesses and projections being at an equal radial distance from said member axis and of a diameter less than the radial dimension of said support surface and spaced from each other in non-intersecting relationship, said recesses and projections being angularly spaced about said member axis upon said ridge support surface in an alternating relationship, and an annular flat ring defined on said member within the general plane thereof intermediate said periphery and said ridge.

2. In combination, a sheet metal container having a body portion having an end defined by a rolled edge, said rolled edge defining a terminal plane, a sheet metal lid of a general planar configuration having a periphery sealingly connected to said body end rolled edge, an axis, an outer side, and located inwardly of said edge terminal plane, an annular ridge defined on said lid from the material thereof concentric with said lid axis axially extending from the general plane of said lid in the direction of said lid outer side and radially spaced inwardly of said periphery, said ridge having a flat support surface substantially parallel to the general plane of said lid and axially located at least coincident with said body rolled edge terminal plane, a plurality of axially extending rounded and concave recesses defined in said ridge support surface, a plurality of axially extending rounded and convex projections defined in said ridge support surface complementary in configuration and dimension to said recesses, said recesses and projections being an equal radial distance from said lid axis and of a diameter less than the radial dimension of said support surface and being angularly spaced about said lid axis upon said ridge support surface in an alternating relationship and spaced from each other in non-intersecting relationship, and an annular flat ring defined on said lid within the general plane thereof intermediate said ridge and said periphery.

* * * * *